US005899328A

United States Patent [19]

Dulyea, Sr.

[11] Patent Number: 5,899,328

[45] Date of Patent: May 4, 1999

[54] GOLF BAG CONSTRUCTION

[76] Inventor: Kenneth W. Dulyea, Sr., 5159 Brookside Ct., Whitehall, Mich. 49461

[21] Appl. No.: 08/908,933

[22] Filed: Aug. 8, 1997

[51] Int. Cl.[6] ..... A63B 55/00

[52] U.S. Cl. ..... 206/315.3; 211/70.2; 206/315.6

[58] Field of Search ..... 248/213.2; 211/16, 211/86.01, 105.1, 70.2; 206/315.2, 315.6, 315.8, 315.3

[56] References Cited

U.S. PATENT DOCUMENTS

| | | | |
|---|---|---|---|
| 562,229 | 6/1896 | Lenney | 248/213.2 |
| 1,570,500 | 1/1926 | Kennedy . | |
| 4,263,950 | 4/1981 | Brown . | |
| 4,753,446 | 6/1988 | Mills . | |
| 4,953,768 | 9/1990 | Muse . | |
| 5,029,703 | 7/1991 | Dulyea, Sr. . | |
| 5,255,781 | 10/1993 | Dulyea, Sr. . | |
| 5,366,075 | 11/1994 | Mills . | |
| 5,431,278 | 7/1995 | Gretz | 206/315.6 |
| 5,458,240 | 10/1995 | Rich et al. | 206/315.6 X |

*Primary Examiner*—Allan N. Shoap
*Assistant Examiner*—Tri M. Mai
*Attorney, Agent, or Firm*—Dennison, Meserole, Pollack & Scheiner

[57] ABSTRACT

The assemblable components of the golf bag include a full height corrugated organizer which, through snap-in-position tabs, lock to an upper retaining rack and a lower support base for subsequently receiving a wrap-around cover releasably secured to the rack and base.

17 Claims, 4 Drawing Sheets

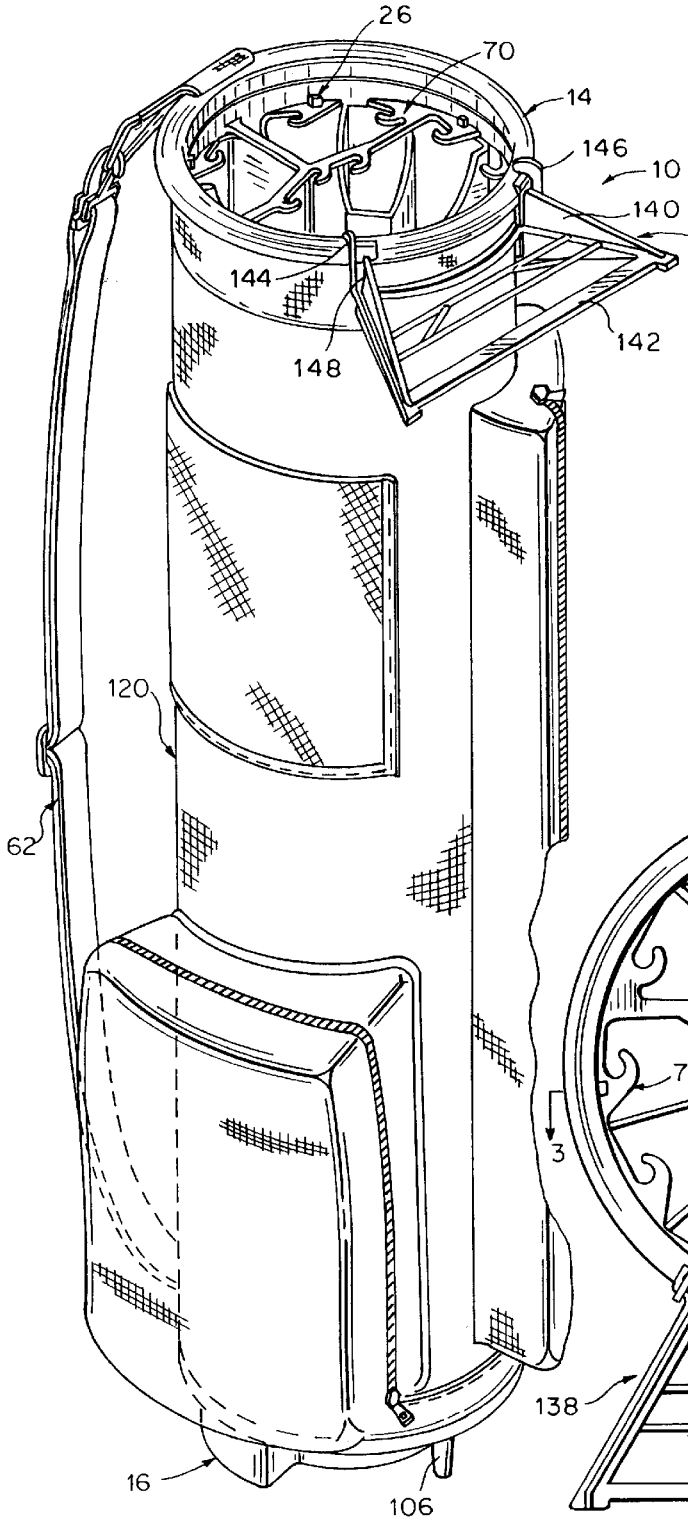
FIG. 1
FIG. 2
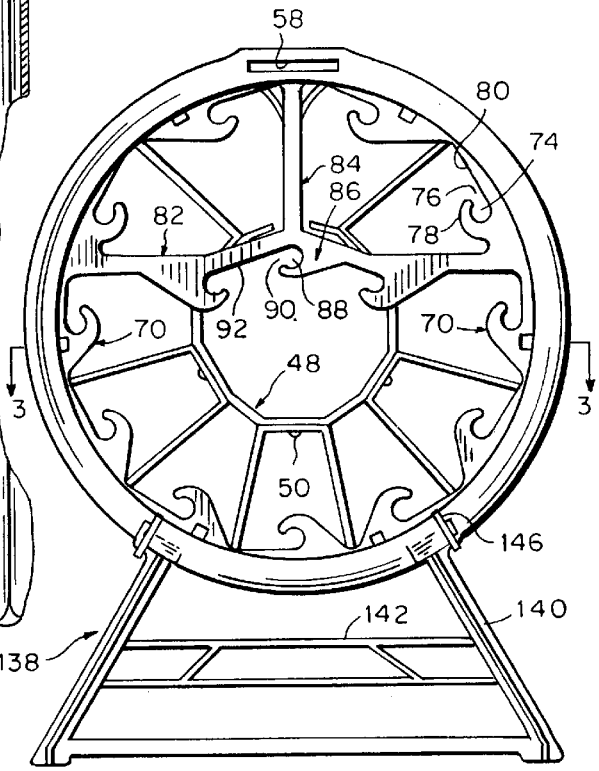

FIG. 3
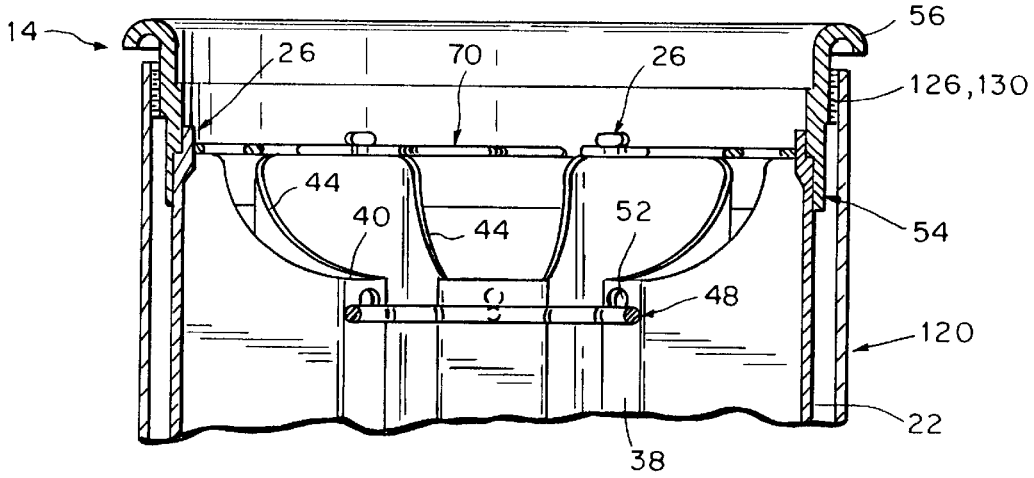
FIG. 4
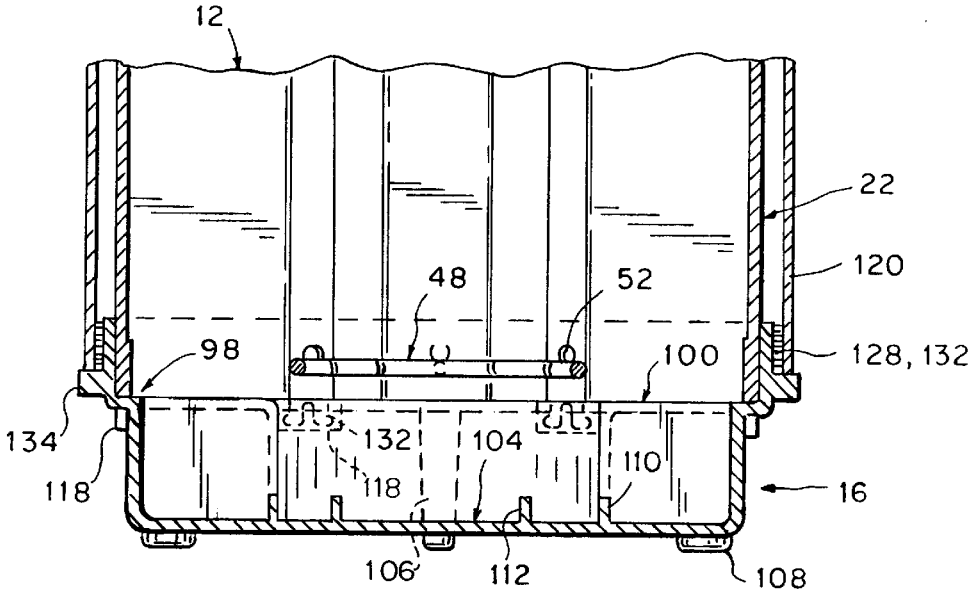
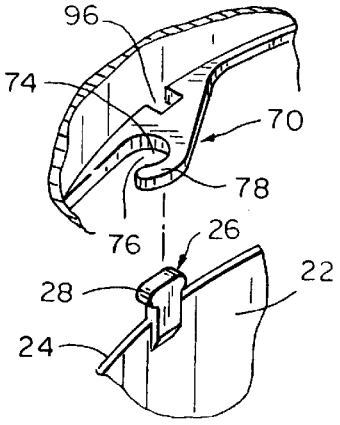
FIG. 8
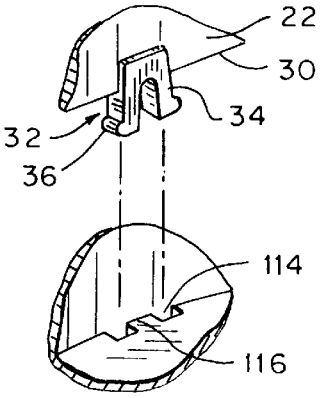
FIG. 9

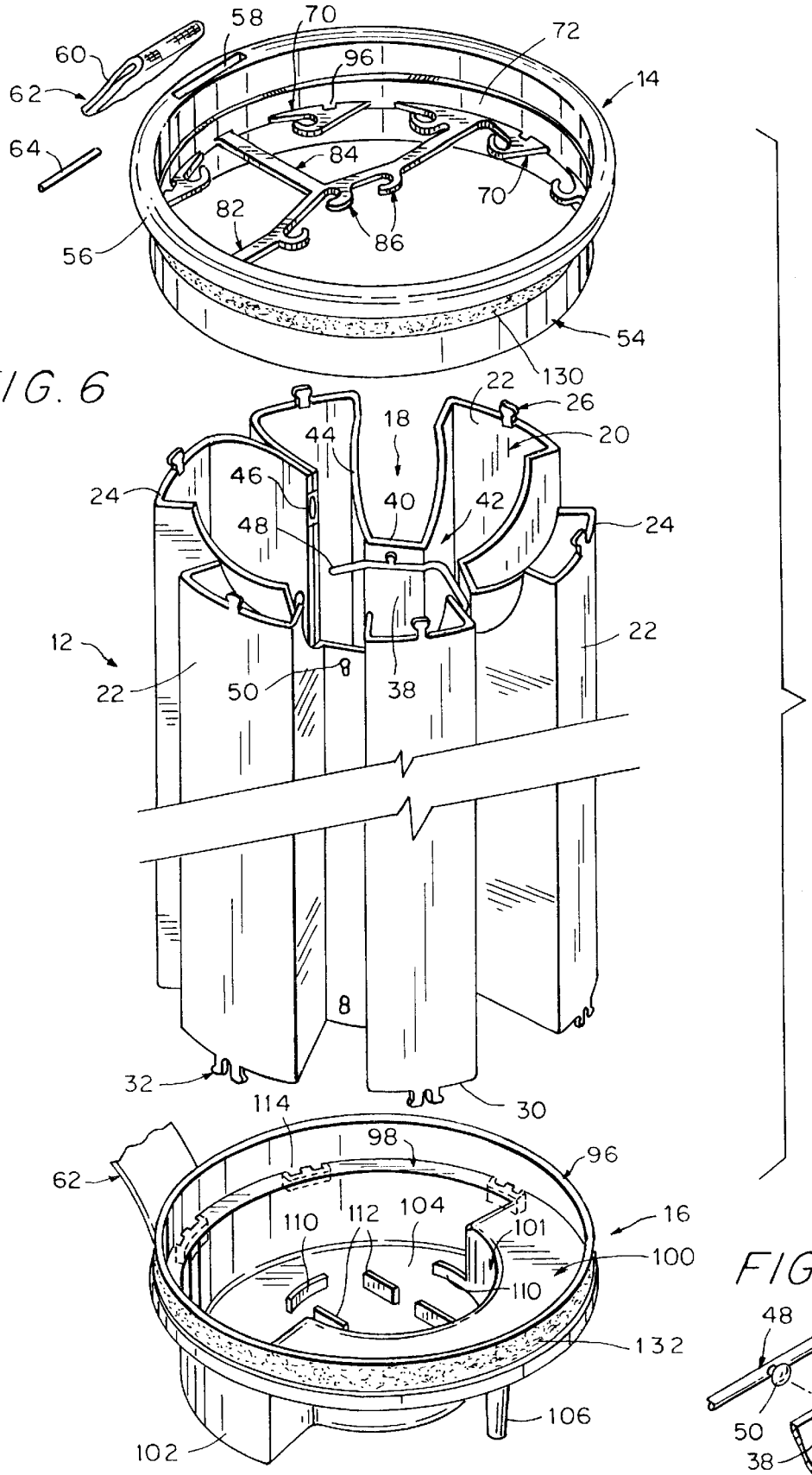
FIG. 6
FIG. 7
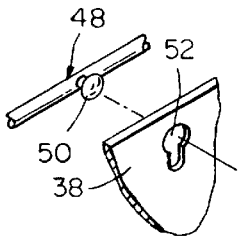

GOLF BAG CONSTRUCTION

BACKGROUND OF THE INVENTION

A golf bag, in its most basic form, is an elongate, preferably cylindrical bag with a closed bottom and an open top. Such bags give substantially no protection to the clubs received therein, and merely provide a convenient means for carrying multiple clubs.

In order to provide better protection for the clubs and to arrange the clubs for easy access to selected clubs, a golf bag has become a rather elaborate construction including golf club organizers which segregate the clubs for the full length thereof, and both bases and upper end retaining racks for engaging and stabilizing the handle ends and the head ends of the clubs. Note, for example, applicant's prior U.S. Pat. Nos. 5,029,703, issued Jul. 9, 1991, and 5,255,781, issued Oct. 26, 1993.

While the noted club organizing components, preferably molded of a substantially rigid synthetic resinous material, will inherently tend to rigidify the bag construction upon insertion into a preformed fabric or leather bag cover, this is generally secondary to the main function of organizing and stabilizing the clubs within the bag.

SUMMARY OF THE INVENTION

The golf bag of the present invention is unique both in its use of the club organizing components as the structural components of the bag, and in the manner in which the components are assembled into a highly stable unit by utilizing snap-in tabs or lugs which provide for an assembly without requiring tools or elaborate assembly procedures.

In conjunction therewith, and another significant aspect of the invention is the provision of a removable outer bag cover which, as opposed to the conventional pre-sewn cylindrical bag cover, is a flat sheet or panel of appropriate, preferably synthetic resinous, fabric which is wrapped about the structural components of the bag with the free vertical edges secured by appropriate hook and loop fasteners extending along the full length of such edges. The upper and lower edges of the cover are in turn directly adhered to an upper retaining rack and a lower base also by appropriate hook and loop fasteners. The cover, formed in this manner, is easily removed for cleaning or replacement purposes, as well as to provide for customized printing or embroidering thereon. It will also be recognized that the exterior of the cover is to be provided with appropriate pockets for the various golf accessories normally carried with the bag.

Structurally, the bag assembly includes an organizer formed of a corrugated sheet rolled into a self-sustaining tubular configuration which snap-locks to an upper circular retaining rack integrally mounting a series of club retainers positioned to align with cells defined by the corrugated organizer. The lower end of the organizer in turn snap-locks to a base configured to accommodate clubs of various height.

The snap-locked components are all of a substantially rigid synthetic resinous material and together form the support structure of the bag. As will be appreciated, while the components will normally define a circular and cylindrical profile, other configurations, for example oval, are also possible.

The bag is completed by the cover, in the nature of a fabric sheet, which wraps about the organizer and adjacent portions of the upper rack and lower base and intimately mounts to the rack and base by engaging hook and loop fasteners applied respectively to the cover and both the rack and base. The free vertical ends of the cover sheet are in turn fastened along the full length thereof, again preferably by intimately engaging hook and loop fasteners.

Other features, objects and advantages of the invention will become apparent from the more detailed description following hereinafter.

BRIEF DESCRIPTION OF THE DRAWINGS

FIG. 1 is a perspective view of the completely assembled golf bag;

FIG. 2 is a top plan view of the golf bag;

FIG. 3 is a cross-sectional view through the upper portion of the golf bag taken substantially on a plane passing along line 3—3 in FIG. 2;

FIG. 4 is a similar transverse cross-sectional view taken through the lower portion of the golf bag;

FIG. 6 is an exploded perspective view of the organizer, upper rack and lower base;

FIG. 7 is a perspective detail illustrating the manner of mounting the bracing collar for the organizer;

FIG. 8 is a perspective detail of the snap or press fit engagement between the upper portion of the organizer and the overlying retaining rack; and FIG. 9 is a perspective detail illustrating the manner of press fitting or snap locking the lower end of the organizer to the base.

DESCRIPTION OF PREFERRED EMBODIMENT

Figure 5:
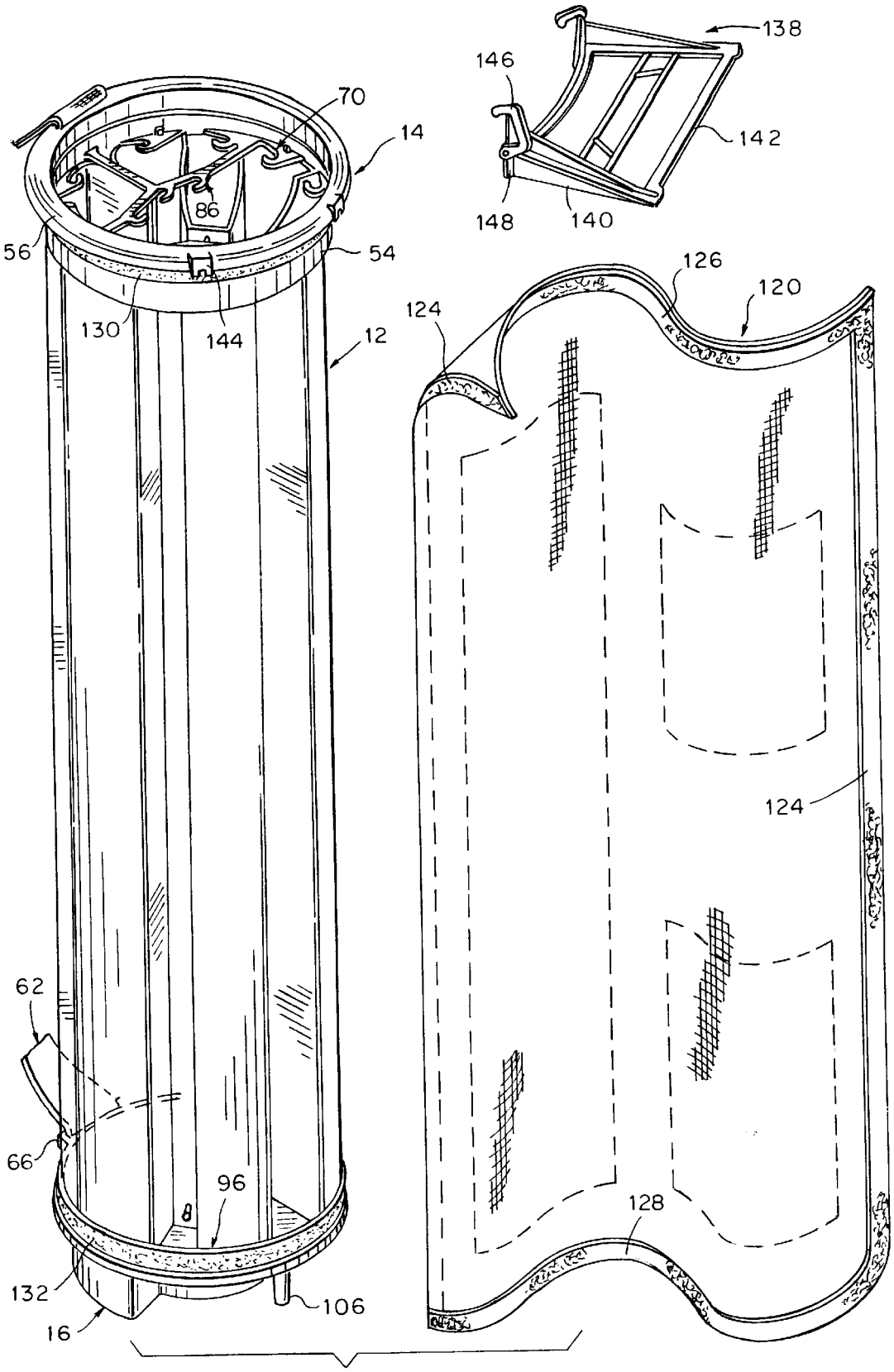
FIG. 5 is a perspective view of the assembled organizer, retaining rack and base, with the removable cover and towel rack exploded therefrom.

The golf club bag 10 is basically comprised of four components which interfit, utilizing hand-manipulable fasteners, to provide a structurally stable protective carrying enclosure for golf clubs. Three of these components, a vertically elongate corrugated organizer 12, an upper retaining rack 14, and a lower base 16, all formed of an appropriate substantially rigid synthetic resinous material, provide for both the structural rigidity for the bag and for the separation, organization and protection of the individual clubs.

The organizer 12 is formed from a single sheet of corrugated material rolled into a self-sustaining tubular configuration as illustrated in the drawings. In its tubular configuration, the organizer has the full length corrugations therein defining a series of longitudinal, alternating outwardly opening and inwardly opening compartments or cells 18 and 20. The inwardly directed compartments have full height rear or back walls 22 which define an outer periphery. Each of these back walls has a flat upper edge 24 with a centrally located upwardly projecting locking tab or lug 26. Noting FIG. 8 in particular, the tab or lug 26, for strength, is preferably slightly wider than the wall 22 of the organizer and includes a transversely enlarged locking head 28 spaced a distance above the upper edge 24 of the wall 22 to ensure proper engagement with the overlying retaining rack 14 as shall be explained subsequently.

The lower straight edge 30 of the rear wall 22 of each inwardly directed compartment 20 is similarly provided with a projecting integral and relatively thicker lug or tab 32. As noted in the detail of FIG. 9, the lug 32 is bifurcated or defined by a pair of laterally spaced legs 34, each including a laterally outward projecting extension or gripping head 36 thereon for snap-locking engagement with the base 16 as shall be described subsequently.

The rear or back wall 38 of each of the outwardly opening compartments 18 has an upper edge 40 below that of the upper edges 24 of the walls 22 with the opposed compartment side walls 42 having concave upper edges 44 arcing downward between the corresponding inner walls 22 and 38, thus facilitating top access to the compartments 18 and 20 below the overlying retaining rack 14. The back walls 38 define an inner periphery about a hollow core.

Noting FIG. 6 in particular, the free edges of the corrugated sheet which is rolled to define the organizer 12 are secured together, as at 46, by any appropriate fastener means including clips, spot welding, and the like.

Additional stability and rigidity is introduced into the organizer by upper and lower substantially rigid rod-like bands or collars 48 engaged with the inner faces of the walls 38 within the organizer adjacent both the upper and lower edges thereof. Each band lies against the inner faces of each of the walls 38 and includes an integral outwardly projecting headed lug 50 aligned with each wall 38 and engaged through a corresponding keyhole slot 52 therein. This interlocking engagement will be best noted in the perspective detail of FIG. 7. Upon engagement of the lugs 50 through the corresponding slots 52, the band is shifted slightly downward to lock the lugs 50 within the slot 52. The upper and lower bands 48 provide a substantial degree of stabilization to the organizer at the top and bottom thereof without interference with the defined club-receiving spaces or hollow core. It will also be recognized that the bands 48 overlie the open inwardly directed mouths of the inwardly opening compartments 20 to provide an additional means for retaining the clubs positioned within these compartments.

The retaining rack 14 includes a peripheral wall 54 with an integral outwardly rolled upper edge flange 56. The upper edge flange 56 includes an elongate slotted bracket 58 integrally defined therein to receive and mount the looped upper end 60 of the shoulder strap 62. This looped end is received through the slot and, immediately below the flange 56, receives an elongate pin 64 of a size sufficient to preclude withdrawal of the looped end 60 back through the slot. The pin 64 itself will be concealed beneath the flange 56. The lower looped end of the shoulder strap 62 will be similarly engaged through and "pinned" beneath a slotted projection 66 on the base 16.

In order to secure the golf club shafts within the retaining rack, a plurality of retainers 70 are provided at generally equal spacing on and projecting inward from the inner surface of the rack wall 54 at approximately mid-height therein. As desired, for molding purposes, the retainers 70 can be integrally molded with a mounting collar 72 which is subsequently permanently affixed to the inner wall surface.

Each of the retainers 70 includes a laterally directed gripping notch or recess 74 therein opening in a circumferential direction about the wall 54 and having a slightly restricted mouth 76 defined by an arcuate outer lip or notch wall 78. Each of these retainers 70 includes an inner edge 80 in the nature of a ramp leading from the inner surface of the peripheral wall 54 into the notch 74. Thus, introduction of a club shaft within the notch 74 is quickly and efficiently achieved by engaging the shaft with the edge 80 and sliding the shaft into the notch 74. As will be appreciated, the retainers 70, while substantially rigid, have sufficient resilient flexibility to allow for a snap engagement of the shaft into the notch and a similar release of the shaft from the notch.

The peripheral retainers are located so as to individually align above the organizer compartments 18 and 20, thus providing for a retained reception of a single club in a single compartment. The substantially central positioning of each retainer 70 relative to the corresponding compartment 18, 20 allows for sufficient room to manipulate the shaft into engagement with and disengagement from the corresponding retainer 70. This relationship will be best noted in FIG. 2.

In order to utilize the central portion of the organizer 12, a cross bar 82, the opposed ends of which are integral with opposed portions of the rack wall or retainers thereon, spans the opening defined by the peripheral wall 54 to one side of the diametric center of the opening, dividing the opening into larger and smaller subdivisions. The smaller subdivision in turn is centrally divided by a partition bar 84 extending across the smaller opening subdivision centrally from and at right angles to the cross bar 82 and to the peripheral wall, thus dividing the small subdivision into two yet smaller areas and effectively stabilizing and bracing the cross bar 82.

Noting the top plan view of FIG. 2 in particular, it will be seen that the cross bar 82, aligned across the hollow central area of the organizer 12, immediately inward of the circular stabilizing rods 48, include three integral retainers 86. Each of these retainers 86 is formed similar to the retainers 70 with laterally directed shaft-receiving notches 88, restricted mouths 90 and inclined ramp edges 92 leading to the notches 88. Also, as with the retainers 70, the retainers 86 are inherently of sufficient flexible resiliency as to snap-lock to the club shafts, while also having sufficient rigidity as to retain and properly orient the retained clubs.

In order to assemble and provide for a positive joinder of the retaining rack 14 to the organizer 12, each of the peripheral retainers 70 which aligns with the back wall 22 of an inwardly directed organizer cell 20 includes a vertical aperture 96 therethrough immediately adjacent the inner face of the rack wall 54. These apertures 96 are of a size as to allow for a press-fitting of the enlarged head 28 of an aligned organizer-mounted tab or lug 26 therethrough, the retainer and/or lug 26 having sufficient flexible resiliency as to allow for this snap-locking engagement, and sufficient rigidity as to preclude disengagement in the absence of positive manual pressure. With the organizer 12 so mounted to the rack 14, it will be recognized that the upper portion of the organizer is received in intimate engagement with the inner surface of the rack wall 54 immediately below the retainers 70, thus providing for a substantial additional stabilization therebetween.

The base 16 includes a peripheral wall 96, illustrated as circular to conform to the circular retaining rack 14. A peripheral support ledge 98 extends inwardly from the lower edge portion of the inner surface of the base wall 96 along an arc substantially equal to that defined by the larger subdivision to one side of the cross bar 82 of the rack 14. This ledge widens into a substantially greater support platform 100 which in turn generally corresponds to the arc of the smaller subdivision defined in the rack 14 by the cross bar 82 and in turn divided by the partition bar 84.

A depending well 102, inward of the ledge 98 and platform 100, is aligned with and generally coextensive with the larger subdivision of the rack 14 to one side of the cross bar 82 and is formed by a peripheral wall 102 following the arc of the inner edge of the ledge 98 between the opposed ends of the arcuate platform 100, and following a smaller arc 101 defined by the inner arcing edge of the platform 100. The well includes a generally planar bottom 104 which, together with an elongate support leg 106 depending from a central point on the undersurface of the platform 100, provides for the vertical support of the assembled bag. As noted in the cross-sectional detail of FIG. 4, short support feet 108 can be provided on the undersurface of the bottom 104 of the well.

The platform 100, and the retainers 70 thereover in the smaller subdivision of the rack 14, are particularly adapted to handle the shorter clubs. The longer clubs, in turn, will have the handle ends thereof received within the well into supported engagement on the bottom 104 thereof. This will include both the clubs engaged with the peripheral retainers 70 in the larger subdivision of the rack and those secured within the retainers on the cross bar 82. In order to assist in stabilizing the lower ends of the longer clubs, especially those received within the central area of the organizer 12 and retained by the retainers 86 on the cross bar 82, the bottom 104 of the well is provided with two sets of dividers or positioning ribs, one set including arcuate segments 110 which, together with the arcuate inner periphery 101 of the platform 100 define a circular area generally corresponding to the circular central area of the organizer 12. The second set of dividers include two pairs of aligned laterally spaced dividers 112 extending generally diametrically across the circle defined by the arcuate ribs 110 and the arcuate inner periphery 101 of the platform 100, thus dividing this space into three cells corresponding to the three retainers 86 on the cross bar 82.

The support ledge 98 and the outer periphery of the relatively larger platform 100 are provided with peripherally spaced dual apertures 114 which are adapted to receive and retain the press-fit dual tabs 32 on the lower edges 30 of the back walls 22 of the inwardly opening cells or compartments 20 of the organizer. These tabs snap-lock through the apertures 114, upon the application of manual pressure, due to inherent flexible resiliency of the material. The dual apertures 114 provide a central bar portion 116 therebetween, note in particular FIG. 9. This bar portion tends to stabilize the two legs 34 of a tab 32 received through the companion apertures 114 and provide a more positive interlock as would be desired between the base 16 and the organizer 12 in light of the tendency to drop the clubs into the bag prior to engagement with the retainers. It will be recognized that the lower edges of the walls 22 of the retainer, upon an engagement of the tabs 32, will seat directly on the support ledge 98 and the support platform 100. Further, and in order to protect the bottom tabs 32, the undersurface of the ledge 98 and platform 100, about each of the apertures 114, can be provided with a depending sleeve 118 of a height at least equal to that of the head projections extending below the undersurface of the ledge and platform.

The golf bag 10 is completed by the mounting of a removable cover 120 about the full height of the organizer and into fixed engagement with the upper retaining rack 14 and the lower base 16.

The cover 120 is flexible and preferably formed of an appropriate synthetic resinous material of the type conventionally used in golf bags. As desired, other appropriate material can be used.

The cover 120 is basically a flat elongate rectangular sheet having an exterior surface with appropriate accessory bags or pockets 122 affixed thereto in any appropriate manner. The opposed vertical edges of the cover 120 include complementary hook and loop fastener components 124, one on the rear face of the sheet and one on the front face of the sheet, mounted along the full length thereof. In this manner, the vertical edges of the sheet, after an encircling of the cover about the bag support structure, are overlapped and the fastener components 124 secured to each other in a manner providing for a full length vertical seal.

Hook and loop fastener components 126 and 128 are respectively provided along the full length of the upper and lower edges of the cover 120 and in turn engage complementary or mating hook and loop fastener components 130 and 132 respectively encircling and affixed to the rack wall 54 immediately below the upper edge flange 56 and the base wall 96. As will be best noted in FIG. 6 and the cross-sectional detail of FIG. 4, the base wall 96 includes an annular support ledge 134 immediately below the wall encircling fastener component 132, this ledge 134 directly receiving and supporting the lower edge of the cover 120. The upper, fastener secured edge of the bag 120 is substantially concealed beneath the overlying rack flange 56. While other forms of fasteners may be used, hook and loop fabric fasteners, for example, Velcro® are much preferred as providing a full length seal forming a continuous full edge joinder and support.

As will be recognized, the cover 120 is removable, and as such particularly lends itself to customizing, for example embroidering the golf course name or owner's name thereon, cleaning, replacement and the like. It will also be recognized that the cover, fixedly joined to the overlying rack 14 and underlying base 16 provides a structural function in retaining the rack and base in position as a secondary means to the upper and lower tab interlocks.

With reference to FIGS. 1, 2 and 5 in particular, it will be noted that provision can also be made for an auxiliary towel rack 138. The rack including side bars 140 with transverse bars 142 extending therebetween. The inner ends of the side bars, and particularly the upper edge portions thereof, are vertically received upwardly into a pair of notched lugs 144 integrally molded with the rack flange 56, after which a pair of gripping hooks 146, pivoted to the side bars 140 toward the rear thereof, are swung rearwardly of the rack 138 into hooked engagement over the upper flange 56 of the rack 14 to combine with the notched lugs 144 in stably mounting the towel rack 138 to the retaining rack 114. It will be noted that the rearmost cross bar on the rack 138 is arced to conform to the circular periphery of the rack wall 54 below the flange 56. In addition, the rear edges of the side bars 140 can include laterally extending flanges 148 which lie immediately inward of the notched tabs 144 for additional stability.

Referring again to the shoulder strap 62, it will also be appreciated that as the bag is carried by the strap, the major support force is upward on the base 16, thus also contributing to the structural assembly.

The described bag, notwithstanding the simplicity of the assembly thereof and the advantages derived from, such as the replacement of components as desired, has all of the strength and structural stability required of a golf bag.

The foregoing is illustrative of the invention, and while a specific embodiment has been illustrated and described, it is to be appreciated that the scope of the in invention is only to be limited by the scope of the claims appearing hereinafter.

I claim:

1. Golf bag construction comprising a vertically elongate structurally stable club organizer defining vertically elongate compartments, said organizer having an upper end and a lower end, a club retaining rack over said organizer, first fastener means securing said upper end of said organizer to said rack, a base under said organizer, second fastener means securing said lower end of said organizer to said base, a bag cover encircling and enclosing said organizer and adjacent portions of said rack and said base, third fastener means securing said cover directly to said rack, and fourth fastener means securing said cover directly to said base, said upper end of said organizer being received within said rack, said first fastener means comprising apertures on one of said organizer and said rack, and lugs on the other of said organizer and said rack, said lugs snap interlocking within said apertures upon manual forcing of said lugs into said apertures, said lower end of said organizer being received within said base, said second fastener means comprising second apertures on one of said organizer and said base, and second lugs on the other of said organizer and said base, said second lugs snap interlocking within said second apertures upon manual forcing of said second lugs into said second apertures, said cover being formed of a flexible sheet of material wrapped about said organizer, said sheet having an upper edge and a lower edge respectively engaged about said rack and said base, said third fastener means comprising a hook and loop fastener having a first component mounted peripherally about said rack and a second component extending along approximately the full length of the upper edge of said sheet for an intimate and continuous securing of said upper edge of said sheet to said rack, said fourth fastener means comprising a hook and loop fastener with a first component thereof extending completely about said base and a second component thereof extending along substantially the full length of said lower edge of said sheet for an intimate and continuous securing of said lower edge of said sheet to said base.

2. The golf bag construction of claim 1 wherein said cover-forming sheet includes opposed vertical edges with complementary hook and loop fasteners continuously along said edges for an intimate securing of said vertical edges along the full height of said cover subsequent to encircling said organizer.

3. The golf bag construction of claim 1 wherein said retaining rack includes an outwardly directed arcing flange peripherally thereabout and overlying the secured upper end of said cover sheet.

4. The golf bag construction of claim 3 including a peripheral support surface in said base, said lower end of said organizer engaging said support surface peripherally about said base.

5. The golf bag construction of claim 4 including an outer support ledge on and peripherally about said base, said lower edge of said cover sheet being positioned immediately above said support ledge.

6. The golf bag construction of claim 5 including a shoulder strap having an upper end fixed directly to said retaining rack, and a lower end fixed directly to said base.

7. Golf bag construction comprising a vertically elongate structurally stable club organizer defining vertically elongate compartments, said organizer having an upper end and a lower end, a club retaining rack over said organizer first fastener means securing said upper end of said organizer to said rack, a base under said organizer, second fastener means securing said lower end of said organizer to said base, a bag cover encircling and enclosing said organizer and adjacent portions of said rack and said base, third fastener means securing said cover directly to said rack, and fourth fastener means securing said cover directly to said base, said upper end of said organizer being received within said rack, said first fastener means comprising apertures on one of said organizer and said rack and lugs on the other of said organizer and said rack, said lugs snap interlocking within said apertures upon manual forcing of said lugs into said apertures, and an auxiliary towel rack mountable on said: retaining rack, said towel rack including a pair of laterally spaced side bars having rear end portions, said retaining rack including downwardly directed notches receiving said side bar rear end portions upward therein, and a pivotally mounted gripping hook on each of said side bars and selectively movable into overlying relation to said retaining rack in general vertical alignment above said notches.

8. Golf bag construction comprising a vertically elongate structurally stable club organizer defining vertically elongate compartments, said organizer having an upper end and a lower end, a club retaining rack over said organizer, first fastener means securing said upper end of said organizer to said rack, a base under said organizer, second fastener means securing said lower end of said organizer to said base, a bag cover encircling and enclosing said organizer and adjacent portions of said rack and said base, third fastener means securing said cover directly to said rack, and fourth fastener means securing said cover directly to said base, said cover being formed of a flexible sheet of material wrapped about said organizer, said sheet having an upper edge and a lower edge respectively engaged about said rack and said base, said third fastener means comprising a hook and loop fastener having a first component mounted peripherally about said rack and a second component extending along approximately the full length of the upper edge of said sheet for an intimate and continuous securing of said upper edge of said sheet to said rack, said fourth fastener means comprising a hook and loop fastener with a first component thereof extending completely about said base and a second component thereof extending along substantially the full length of said lower edge of said sheet for an intimate and continuous securing of said lower edge of said sheet to said base.

9. Golf bag construction comprising a vertically elongate structurally stable club organizer defining vertically elongate compartments, said organizer having an upper end and a lower end, a club retaining rack over said organizer, first fastener means securing said upper end of said organizer to said rack, a base under said organizer, second fastener means securing said lower end of said organizer to said base, a bag cover encircling and enclosing said organizer and adjacent portions of said rack and said base, third fastener means securing said cover directly to said rack, and fourth fastener means securing said cover directly to said base, said retaining rack including a plurality of club retainers, one aligned over each of said organizer compartments, said retainers being positioned principally about the periphery of said rack with each retainer defining a laterally directed notch for slidably receiving a golf club shaft therein upon a peripheral movement of a golf club shaft within the corresponding compartment.

10. The golf bag construction of claim 9 wherein said base includes a depending well therein aligned with selected ones of said organizer compartments and said retainers.

11. The golf bag construction of claim 10 wherein said organizer is defined by a rolled corrugated sheet and wherein selected ones of said compartments are inwardly opening compartments and selected others of said compartments are outwardly opening compartments, said compartments being defined by side walls, said inwardly opening compartments having back walls defining an outer periphery of said organizer, said outwardly opening compartments having back walls defining an inward periphery of said organizer surrounding a hollow core, said side walls having upper edges inclined inwardly and downwardly between said outer periphery and said inner periphery.

12. The golf bag construction of claim 11 including a generally annular stabilizing collar within said organizer core and engaged with each of the back walls of said outwardly opening compartments.

13. An assemblage of components for the manual assembly of a golf bag, said assemblage including a vertically elongate substantially rigid organizer having full height vertical compartments, said organizer having opposed upper and lower edges, upper and lower fastener components on said upper and lower organizer edges and extending respectively therefrom, a golf club retaining rack and a base adapted to receive the upper and lower edges of said organizer respectively therein, said retaining rack including fastener components for receiving and locking to the fastener components on the upper edge of said organizer, said base having fastener components for receiving and locking to said fastener components on the lower edge of said organizer, and a golf club cover selectively mountable about said organizer, said cover being formed of a flexible sheet of material having upper and lower edges with fastener components defined along said sheet upper and lower edges respectively, and companion fastener components for said sheet fastener components on said retaining rack and said base respectively for selectively receiving and engaging with said fastener components on said cover sheet, said fastener components on said upper and lower edges of said cover sheet, and said companion fastener components on said retaining rack and said base comprising cooperating hook and loop fasteners which, respectively, completely encircle said retaining rack and said base, and extend along the full extent of said upper and lower cover sheet edges.

14. Golf bag construction comprising a rigid upper retaining rack and a rigid lower base, said retaining rack including a peripheral wall with an inner surface defining an interior area, said wall having a series of peripherally spaced retainers on and projecting inward of said inner surface, said retainers defining laterally directed notches opening in a peripheral direction about said wall inner surface, said base including a peripheral wall which defines a periphery substantially equal to a periphery defined by the retaining rack wall, said base wall defining an interior upwardly opening space with an arcuate support platform therein and a well adjacent said platform, said well including a bottom surface vertically below said platform and defining, with said platform, two different height support surfaces for accommodating golf clubs of different height, and means for joining said retaining rack and said base in vertically spaced alignment with each other.

15. The construction of claim 14 wherein said retaining rack includes an internal cross bar dividing the interior area thereof into two subdivisions, one larger than the other, the larger subdivision aligning over said base well, said cross bar having club retainers defined thereon and including laterally directed club-receiving notches therein.

16. Golf bag construction comprising a vertically elongate structurally stable club organizer defining a vertically elongate central area, said organizer having an upper end and a lower end, a club retaining rack over said organizer, first fastener means for securing said upper end of said organizer to said rack, a base under said organizer, second fastener means for securing said lower end of said organizer to said base, a bag cover encircling and enclosing said organizer and adjacent portions of said rack and said base, third fastener means for securing said cover to said rack, and fourth fastener means for securing said cover to said base, said cover being formed of a flexible sheet of material wrapped about said organizer, said sheet having an upper edge and a lower edge respectively engaged about said rack and said base, said third fastener means comprising a hook and loop fastener having a first component provided peripherally on and about said rack and a second component extending along approximately the full length of the upper edge of said sheet for an intimate and substantially continuous securing of said upper edge of said sheet to said rack, said fourth fastener means comprising a hook and loop fastener with a first component thereof extending completely about said base and a second component thereof extending along substantially the full length of said lower edge of said sheet for an intimate and substantially continuous securing of said lower edge of said sheet to said base.

17. The golf bag construction of claim 16 wherein said cover-forming sheet includes opposed vertical edges with complementary hook and loop fastener along said vertical edges for an intimate securing of said vertical edges along the height of said cover subsequent to an encircling of said organizer.

* * * * *